US010724774B2

(12) United States Patent
Zhang et al.

(10) Patent No.: US 10,724,774 B2
(45) Date of Patent: Jul. 28, 2020

(54) REFRIGERATING SYSTEM AND PURIFICATION METHOD FOR THE SAME

(71) Applicant: Carrier Corporation, Jupiter, FL (US)

(72) Inventors: Haitao Zhang, Shanghai (CN); Michael A. Stark, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 168 days.

(21) Appl. No.: 15/743,103

(22) PCT Filed: Jul. 11, 2016

(86) PCT No.: PCT/US2016/041710

§ 371 (c)(1),
(2) Date: Jan. 9, 2018

(87) PCT Pub. No.: WO2017/011378

PCT Pub. Date: Jan. 19, 2017

(65) Prior Publication Data

US 2019/0078821 A1 Mar. 14, 2019

(30) Foreign Application Priority Data

Jul. 10, 2015 (CN) ..... 2015 1 0402611

(51) Int. Cl.
*F25B 43/04* (2006.01)
*F25B 41/00* (2006.01)
(Continued)

(52) U.S. Cl.
CPC ..... *F25B 43/043* (2013.01); *F25B 5/02* (2013.01); *F25B 7/00* (2013.01); *F25B 41/003* (2013.01)

(58) Field of Classification Search
CPC .. F25B 43/043; F25B 5/02; F25B 7/00; F25B 41/003
See application file for complete search history.

(56) References Cited

U.S. PATENT DOCUMENTS 5,313,850 A 5/1994 Blackmon et al.
6,705,100 B2 * 3/2004 Heiden ..... F25B 43/043 62/195
2018/0187935 A1 * 7/2018 Stark ..... F25B 43/043

FOREIGN PATENT DOCUMENTS

DE 19907435 A1 8/2000
WO 2014179032 A1 11/2014

OTHER PUBLICATIONS

International Search Report and Written Opinion for application PCT/US2016/041710, dated Oct. 10, 2016, 11 pages.
(Continued)

*Primary Examiner* — Cassey D Bauer
(74) *Attorney, Agent, or Firm* — Cantor Colburn LLP

(57) ABSTRACT

The present invention provides a refrigerating system, including: a refrigerating loop (100), including a compressor (190), a condenser (110), a main throttling element (180), and an evaporator (120) that are connected in sequence through a pipeline; and a purification loop (200), including a purification compressor (210), a purification condenser (220), a purification throttling element (240), and a low-temperature separator (230) that are connected in sequence through a pipeline, the purification loop being bidirectionally connected to the refrigerating loop through the low temperature separator and configured to separate a non-condensable gas in the refrigerating loop; wherein the purification condenser is capable of exchanging heat with a refrigerant in the refrigerating loop. Thus, efficient and reliable separation of the refrigerant and the non-condensable gas is achieved.

25 Claims, 2 Drawing Sheets

(51) Int. Cl.
*F25B 5/02* (2006.01)
*F25B 7/00* (2006.01)

(56) References Cited

OTHER PUBLICATIONS

RefTec International, Inc., "Enviropurge Thermal R11/R123/R113/R114 Purge Unit", available at : http://www.reftec.com/images/brochure_ems.pdf, accessed Jan. 9, 2018, 1 page.

* cited by examiner

REFRIGERATING SYSTEM AND PURIFICATION METHOD FOR THE SAME

TECHNICAL FIELD

The present invention relates to a refrigerating system, and in particular, to a refrigerating system having a purification apparatus and a purification method for the same.

RELATED ART

At present, a phenomenon of permeation of a non-condensable gas may occur during manufacturing, transportation or shutdown after use of large-scale refrigeration equipment that uses a low-pressure refrigerant. For example, air permeation, erosion and other reliability problems may occur during the transportation thereof. At this point, generally, a rated amount of a refrigerant and a pressure maintaining gas may be injected into a pipeline thereof in sequence while manufacturing of the equipment is completed. At this point, the pressure maintaining gas artificially injected may also be considered as one kind of the non-condensable gas. Before the equipment officially runs, system performance may be affected greatly if the pressure maintaining gases are not separated. For another example, after the equipment has stopped running for a period of time, as the interior of the pipeline thereof has been in a negative pressure state for a long time, that is, it is lower than the ambient atmosphere pressure, at this point, the ambient air may permeate into the pipeline, to affect the performance when the equipment runs once again. The occurrence of the above problems causes an operation of separating the non-condensable gas for the refrigeration equipment according to a required time to become a necessary. However, there are several problems in the existing refrigerating purification apparatus. For example, for a purification apparatus that uses the principle of low temperature separation, it usually adopts a low-cost air-cooled fin heat exchanger, and such a heat exchanger generally uses a fan and air forced convection to exchange heat, which will result in that the heat exchanging effect thereof is extremely easy to be affected by an ambient temperature. However, such a large-scale unit is generally installed into a client machine room, which is in a relatively closed environment. Therefore, the ambient temperature under such a circumstance is generally higher, and it is difficult to make the purification apparatus that uses the principle of low temperature separation have a better separation effect.

On the other hand, if another non-air-cooled heat exchanger is used, how to additionally arrange a water source/cold source that exchanges heat therewith becomes a derivative technical problem to be solved.

SUMMARY

An objective of the present invention is to provide a specific design for connection between a refrigerating system and a purification loop, so as to implement efficient and reliable separation of a refrigerant and a non-condensable gas.

Another objective of the present invention is to provide a purification method for a refrigerating system, so as to cooperate with use of the system of the present invention to further improve an effect of separation of the refrigerant and the non-condensable gas.

To achieve the aforementioned objectives or other objectives, the present invention provides the following technical solutions.

According to one aspect of the present invention, a refrigerating system is provided, including: a refrigerating loop, including a compressor, a condenser, a main throttling element, and an evaporator that are connected in sequence through a pipeline; and a purification loop, including a purification compressor, a purification condenser, a purification throttling element, and a low-temperature separator that are connected in sequence through a pipeline, the purification loop being bi-directionally connected to the refrigerating loop through the low temperature separator and configured to separate a non-condensable gas in the refrigerating loop;

wherein the purification condenser is capable of exchanging heat with a refrigerant in the refrigerating loop.

According to another aspect of the present invention, a refrigerating system is further provided, including: a refrigerating loop, including a compressor, a condenser, a main throttling element, and an evaporator that are connected in sequence through a pipeline; a purification loop, including a purification compressor, a purification condenser, a purification throttling element, and a low-temperature separator that are connected in sequence through a pipeline, the purification loop being bi-directionally connected to the refrigerating loop through the low temperature separator and configured to separate a non-condensable gas in the refrigerating loop; a first auxiliary flow path, of which a first end is connected with the condenser and a second end is connected with the evaporator; and a second auxiliary flow path, of which a first end and a second end are connected with the evaporator respectively; wherein the first auxiliary flow path and the second auxiliary flow path have a common flow path, and the purification condenser is capable of exchanging heat with a refrigerant in the refrigerating loop through the common flow path.

According to a further aspect of the present invention, a purification method for a refrigerating system is further provided, including: when the refrigerating system runs, opening a first electromagnetic valve, and closing a second electromagnetic valve, wherein a refrigerant is throttled and cooled in a process of flowing through a first auxiliary flow path, exchanges heat with a purification condenser in a purification loop, and then goes back to the evaporator; and/or when the refrigerating system shuts down, opening the second electromagnetic valve and a circulating pump, and closing the first electromagnetic valve, wherein the refrigerant is throttled and cooled in a process of flowing through a second auxiliary flow path, exchanges heat with the purification condenser in the purification loop, and then goes back to the evaporator.

DETAILED DESCRIPTION

Figure 1:
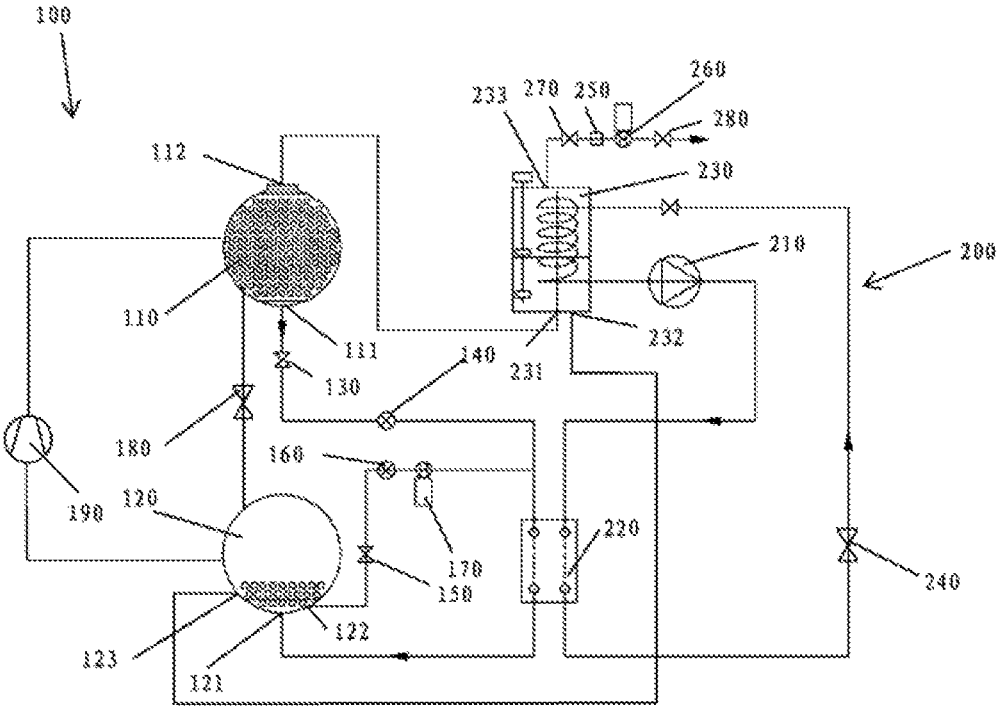
FIG. 1 is a system schematic diagram of an embodiment of a first pipeline connecting manner of a refrigerating loop and a purification loop of a refrigerating system according to the present invention.

Referring to FIG. 1, a refrigerating system is provided, including a refrigerating loop 100 and a purification loop 200. Considering a wide application range of refrigerant purification in this refrigerating system, the refrigerating loop 100 described herein may be a refrigerating loop of any regular large-scale refrigeration equipment, and generally includes a compressor 190, a condenser 110, a main throttling element 180, and an evaporator 120 that are connected in sequence through a pipeline. The refrigerating system further includes the purification loop 200, which is configured to separate a non-condensable gas in the refrigerating loop 100.

Still referring to FIG. 1, the purification loop 200 includes a purification compressor 210, a purification condenser 220, a purification throttling element, such as an expansion valve 240, and a low-temperature separator 230 that are connected in sequence through a pipeline. The purification loop 200 is bi-directionally connected to the refrigerating loop 100 through the low-temperature separator 230. More specifically, the low-temperature separator 230 exists as a fluid exchange medium between the purification loop 200 and the refrigerating loop 100. That is, the mixture of the refrigerant and the non-condensable gas flows into the low-temperature separator 230 from the refrigerating loop 100; after separation and purification by the low-temperature separator 230, the separated refrigerant flows back to the refrigerating loop 100 through the low-temperature separator 230.

On this basis, the purification condenser 220 in the purification loop 200, and the refrigerating loop 100 may be in a heat exchange relationship. Specifically, the purification condenser 220 may be a plate heat exchanger or a micro-channel heat exchanger, which has at least two different flow paths, one is a flow path for a purification working refrigerant to flow through, and the other is a flow path for the refrigerant in the refrigerating loop 100 to flow through. Specifically, the purification condenser 220 may be in a heat exchange relationship with a first auxiliary flow path in the refrigerating system. For example, a first end 111 of the first auxiliary flow path is connected with the bottom of the condenser 110, and a second end 121 is connected with the bottom of the evaporator 120. With such a design, it is possible to use a refrigerant flowing through the first auxiliary flow path to directly exchange heat with the purification condenser 220 in the purification loop 200, which, on the one hand, improves stability of heat exchange without relying on an environment condition, thus increasing efficiency of the purification; and on the other hand, can also provide heat for the refrigerating loop during shutdown, to ensure that pressure in the refrigerating system is higher than atmospheric pressure.

Specifically, a first throttling valve 130 and a first electromagnetic valve 140 should be further arranged on the first auxiliary flow path. The first throttling valve 130 is configured to provide a throttling effect for the refrigerant that flows out of the condenser 110 to participate in heat exchange. The first electromagnetic valve 140 is configured to control opening and closing of the first auxiliary flow path, to cooperate with the system to determine opening of the first auxiliary flow path or the second auxiliary flow path (description is given below in combination with the second auxiliary flow path) according to actual needs.

In addition, according to system analysis, it can be known that, when the system runs, the evaporator 120 is at a lower pressure, and at this point, it is more appropriate to use the refrigerant in the condenser 110 to exchange heat with the purification condenser 220. When the system does not run, the bottom of the condenser 110 may be usually in a dried-up state. Therefore, when the system does not run, it is impossible to use the condenser 110 to exchange heat with the purification condenser 220. Hence, at this point, the evaporator 120 is considered to be used to exchange heat.

According to the aforementioned analysis, the refrigerating system of the embodiment of the present invention further includes a second auxiliary flow path, of which a first end 122 and a second end 121 are connected to the bottom of the evaporator 120 respectively (which connect different ports), so that the system can use the refrigerant in the refrigerating loop 100 to directly exchange heat with the purification condenser 220 in the purification loop 200 under any circumstance, which improves efficiency and reliability of the design.

Specifically, a second throttling valve 150, a second electromagnetic valve 160 and a circulating pump 170 should be further arranged on the second auxiliary flow path. The second throttling valve 150 is configured to provide a throttling effect for a refrigerant that flows out of the evaporator 120 to participate in heat exchange. The circulating pump 170 is configured to provide power for flowing of the refrigerant herein; at this point, the system is in a shutdown state, and thus there is no other power to drive the refrigerant. The second electromagnetic valve 160 is configured to control opening and closing of the second auxiliary flow path, to cooperate with the system to determine opening of the first auxiliary flow path or the second auxiliary flow path according to actual needs, so that only one of the two auxiliary flow paths is in an open state, while the other is in a closed state. More specifically, when it is necessary to purify the system, if the system is working, the first electromagnetic valve 140 is opened, and the second electromagnetic valve 160 is closed; if the system stops, the second electromagnetic valve 160 is opened, and the first electromagnetic valve 140 is closed.

In addition, regarding the system, in order to improve utilization of the pipeline and reduce the complexity and material cost of the pipeline, a second embodiment may also be provided, including a common flow path. The common flow path is a common section in downstream areas of the first auxiliary flow path and the second auxiliary flow path, and the position where heat is exchanged with the purification condenser 220 is disposed at the common flow path, so that the first end 111 of the first auxiliary flow path is connected with the bottom of the condenser 110, while the first end 121 of the second auxiliary flow path is connected with the bottom of the evaporator 120, and their downstream areas are directly merged in the common flow path section and are connected to the bottom of the evaporator 120 through the common second end in the common flow path. The embodiment can also achieve a technical effect similar to that of the first embodiment while saving the cost.

In order to achieve better heat exchange efficiency and purification efficiency, specific position designs of respective connection points will be described in detail next.

Referring to FIG. 1 to FIG. 4, the non-condensable gases may permeate into the system pipeline at the beginning of manufacturing of the equipment, during transportation of the equipment or when the equipment is in the shutdown state, and afterwards, may usually accumulate at a highest position or a local highest position of the whole unit. Therefore, for the convenience of separation and purification of a purification system, the refrigerating loop 100 may be connected into the low-temperature separator 230 from the highest position or the local highest position of the refrigerating system. It should be noted that, because the densities of the non-condensable gases are generally lower than the density of the gaseous refrigerant, these gases should theoretically accumulate at a highest point of the whole system after entering the system pipeline. However, these gases may also directly accumulate at a highest point in a component through which the gases enter the system (that is, the local highest position) in actual application depending on different specific positions at which the non-condensable gases permeate into the system pipeline, but not necessarily flow to the highest position of the whole system along the pipeline.

Figure 2:
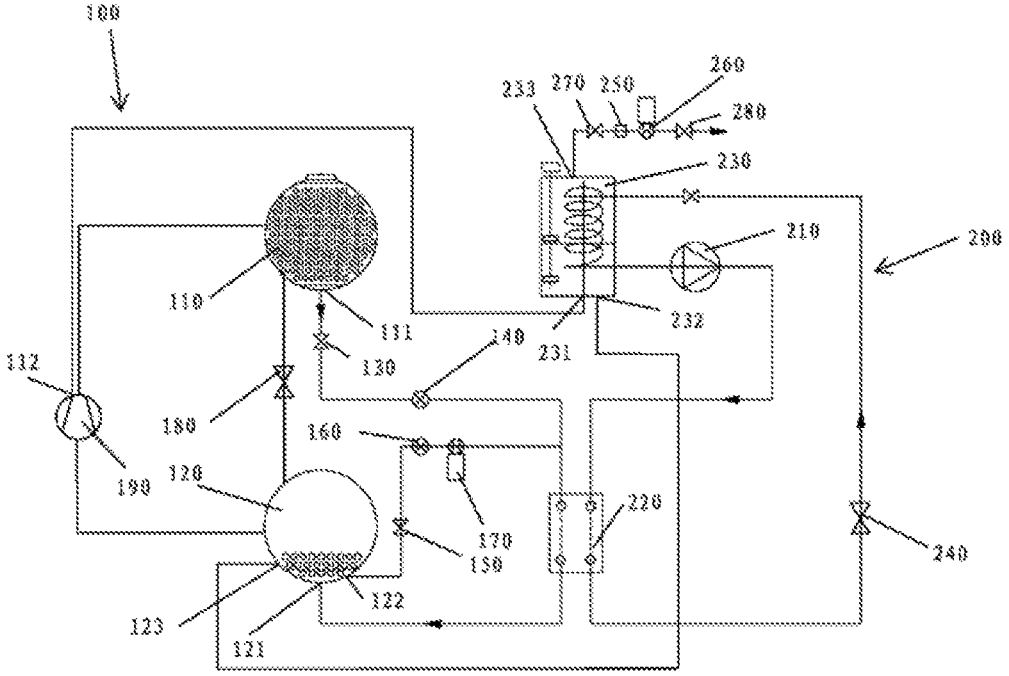
FIG. 2 is a system schematic diagram of an embodiment of a second pipeline connecting manner of a refrigerating loop and a purification loop of a refrigerating system according to the present invention.
Figure 3:
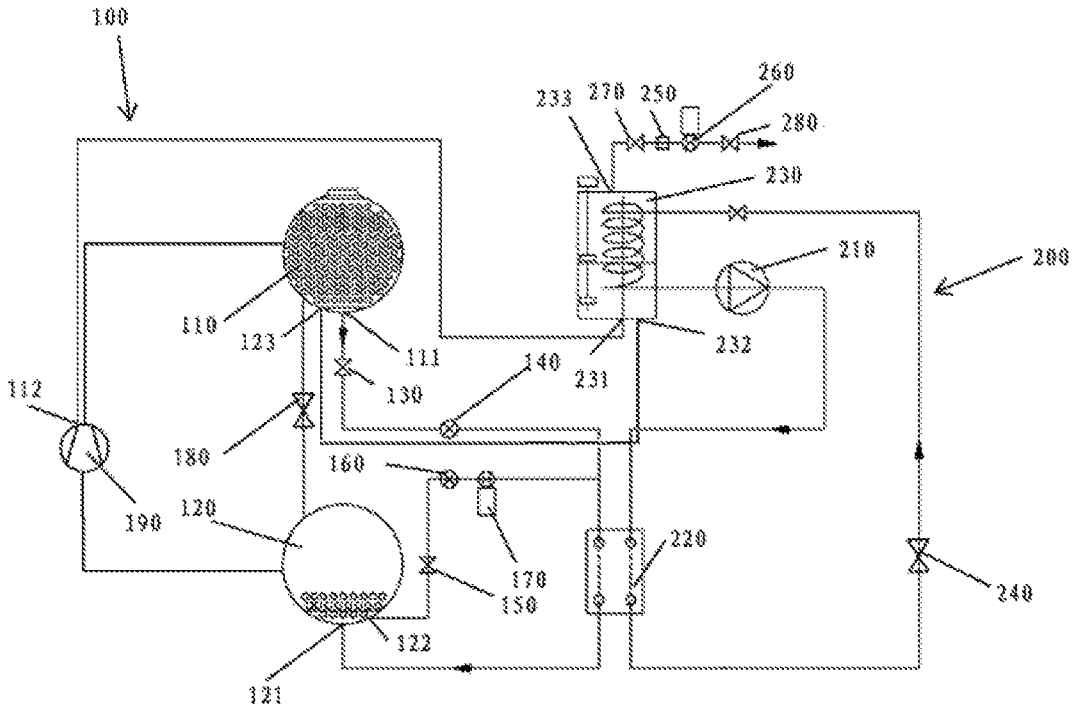
FIG. 3 is a system schematic diagram of an embodiment of a third pipeline connecting manner of a refrigerating loop and a purification loop of a refrigerating system according to the present invention.
Figure 4:
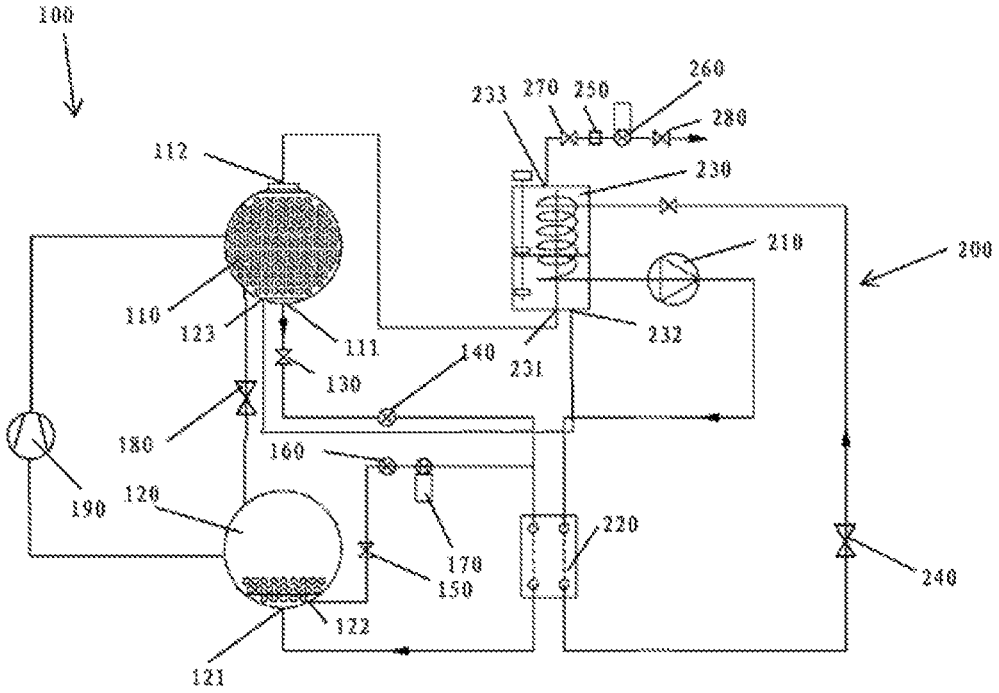
FIG. 4 is a system schematic diagram of an embodiment of a fourth pipeline connecting manner of a refrigerating loop and a purification loop of a refrigerating system according to the present invention.

The highest position of the whole system is generally the top of the compressor according to regular component layout of a large-scale unit, and when the unit runs, a regular non-condensable gas will remain at the top of the condenser due to circulation of the compressor. Therefore, the embodiment of the present invention proposes connecting the refrigerating loop 100 into the low-temperature separator 230 through a flow outlet 112 (as shown in FIG. 1 and FIG. 4) of the refrigerant to be purified at the top of the condenser thereof or a flow outlet 112 (as shown in FIG. 2 and FIG. 3) of the refrigerant to be purified at the top of the compressor. This makes it easier to introduce a mixture of the refrigerant and the non-condensable gas into the low-temperature separator 230, thus implementing separation of the non-condensable gas and the refrigerant in a more optimized manner, and further guaranteeing high performance during subsequent startup and operation of the unit.

In addition, as shown in FIG. 1 and FIG. 2, when the refrigerating loop runs, the low-temperature separator 230 may be connected back to the refrigerating loop 100 from a return port 123 of the purified refrigerant at the bottom of the evaporator 120. Such a design provides a height difference between an inlet 231 of the refrigerant to be purified of the purification loop 200 and the return port 123 of the purified refrigerant; in this case, the refrigerant is driven by the gravity, and may also be pushed by an additional pressure difference at the same time, which improves the driving efficiency.

Out of the same purpose as described above, alternatively, as shown in FIG. 3 and FIG. 4, the low-temperature separator 230 may further be connected back to the refrigerating loop 100 from the return port 123 of the purified refrigerant at the bottom of the condenser. With such a design, the refrigerant can also flow back to the condenser smoothly under the driving of the gravity.

In regard to each opening in the low-temperature separator 230, this embodiment also provides specific design positions thereof. For example, the low-temperature separator 230 has an inlet 231 of the refrigerant to be purified located at the top of the low-temperature separator 230, an outlet 232 of the purified refrigerant located at the bottom of the low-temperature separator 230, and a non-condensable gas outlet 233 located at the top of the low-temperature separator 230. Due to a low temperature separation principle used in this embodiment, the refrigerant that is liquefied at a low temperature can easily flow back to the refrigerating loop 100 from the outlet 232 of the purified refrigerant arranged at a relatively low position, while the non-condensable gas that still maintains a gas state at the low temperature can be easily discharged to the atmosphere from the non-condensable gas outlet 233 arranged at a relatively high position. In addition, by arranging the inlet 231 of the refrigerant to be purified at the top of the low-temperature separator 230, disturbance of the liquid refrigerant accumulating at the bottom of the low-temperature separator 230 by the mixture of the refrigerant and the non-condensable gas is also avoided, which further facilitates the purification operation of the purification loop.

In addition, the purification loop 200 further includes a discharge branch which is connected on the non-condensable gas outlet 233 of the low-temperature separator 230. A regeneration filter 250, an air pump 260, a first valve 270 and a second valve 280 are arranged on the discharge branch. The air pump 260 is configured to provide a pumping force for the non-condensable gas to be discharged, and the regeneration filter 250 is configured to filter traces of refrigerant mixed in the non-condensable gas, to prevent the traces of refrigerant from polluting the atmosphere after escaping. The regeneration filter 250 may release the absorbed refrigerant with a method such as heating or vacuumizing, to recover a filtering capability thereof, that is, to regenerate. Specifically, the regeneration filter may include, but is not limited to: an active carbon filter, a molecular sieve filter, a semi-permeable membrane filter, and the like. In addition, the first valve 270 and the second valve 280 arranged on upper and lower ends of the discharge branch are configured to control opening and closing of the branch.

Optionally, a switch valve or an opening valve may be arranged on each loop or branch to control on/off or opening of the flow path.

Alternatively, the purification loop 200 may include a pressurizing component (not shown), which can assist in pressurizing to adjust a liquefied temperature of the refrigerant to be purified and the non-condensable gas, thus further improving the effect of low temperature separation.

In addition, as the present invention provides selections of different purification loop working manners when the refrigerating system is in an operating state and a non-operating state, the present invention further provides an embodiment of a matching purification method.

Specifically, the method includes the following steps:

1) when the refrigerating system runs, opening a first electromagnetic valve 140, and closing a second electromagnetic valve 160, wherein a refrigerant is throttled and cooled in a process of flowing through a first auxiliary flow path, exchanges heat with a purification condenser 220 in a purification loop, and then goes back to an evaporator 120; and/or 2) when the refrigerating system shuts down, opening the second electromagnetic valve 160 and a circulating pump 170, and closing the first electromagnetic valve 140, wherein the refrigerant is throttled and cooled in a process of flowing through a second auxiliary flow path, exchanges heat with the purification condenser 220 in the purification loop, and then goes back to the evaporator 120.

At this point, the purification loop in the system may be started in a matching manner, the purification refrigerant is compressed through a purification compressor 210, enters into the purification condenser 220 to exchange heat, and after being throttled by an expansion valve 240, enters into a low-temperature separator 230 to exchange heat with a refrigerant to be purified, making it separated into a non-condensable gas and a liquid refrigerant.

In order to better achieve their separation, it is possible to select a refrigerant to make it have the following properties relative to the non-condensable gases: it should have a liquefied temperature lower than that of the selected refrigerant and cannot chemically react with the selected refrigerant and the refrigerating system.

The non-condensable gases may be air, nitrogen or the like.

According to the purification method taught herein, a purification operation is carried out by effectively combining a refrigerating system, which thus avoids high dependence of operation of the purification loop on the environment condition, efficiently achieves separation of the refrigerant and the non-condensable gas, sends the separated refrigerant back to the refrigerating loop, and discharges the non-condensable gas into the atmosphere.

The method above well solves problems such as equipment erosion and degradation of system performance brought about by leakage of the non-condensable gas (for example, air) into the system in the above respective stage, and improves performance and reliability of the system. In addition, the interior of the evaporator 120 may be a negative pressure in the case of shutdown in winter. Therefore, after the above purification method is used, the refrigerant of which the temperature is enhanced after heat exchange with the purification condenser 220 goes back to the evaporator 120, which can also effectively relieve the negative pressure condition thereof and avoid the problem of air permeation.

In the following, to facilitate understanding, a possible separation working process of a mixture of the refrigerant and the non-condensable gas of the equipment is described with reference to the refrigerating system shown in FIG. 1.

When the refrigerating system runs, a first electromagnetic valve 140 is opened, and a second electromagnetic valve 160 is closed. On the one hand, a mixture of the refrigerant and the non-condensable gas is pumped into the low-temperature separator 230 in the purification loop 200 through the inlet 231 of the refrigerant to be purified from the flow outlet 112 of the refrigerant to be purified at the top of the condenser. On the other hand, the purification compressor 210 in the purification loop 200 starts to work, so that a working refrigerant in the purification loop 200 is compressed by the purification compressor 210 and then flows through the purification condenser 220 so as to be condensed; subsequently, the working refrigerant is throttled by the expansion valve 240, and finally enters the low-temperature separator 230 to exchange heat with the mixture of the refrigerant and the non-condensable gas. After that, the working refrigerant flows back to the purification compressor 210, to start a new round of circle. Furthermore, the refrigerant flows out from the condenser 110 through the first end 111 of the first auxiliary flow path, is throttled by the first throttling valve 130 and then flows to the low-temperature condenser 220 to exchange heat with the working refrigerant therein; after that, the heated refrigerant flows into the evaporator 120 through the second end 121 of the first auxiliary flow path, to continue a refrigeration cycle. In this process, after heat of the mixture of the refrigerant and the non-condensable gas is absorbed by the working refrigerant of the purification loop 200 and the temperature of the mixture is lowered, a refrigerant gas having a higher liquefaction temperature is condensed to be a refrigerant liquid and accumulates at a lower portion of the low-temperature separator 230, while the non-condensable gas having a lower liquefaction temperature still maintains a gas state and accumulates at an upper portion of the low-temperature separator 230. After that, the refrigerant liquid enters the evaporator 120 through the outlet 232 of the purified refrigerant at the bottom of the low-temperature separator 230 through the return port 123 of the purified refrigerant, to continue participating into the refrigeration cycle, while the non-condensable gas passes through the non-condensable gas outlet 233 at the top of the low-temperature separator 230 and is discharged to the atmosphere through the discharge branch.

When the refrigerating system stops, the second electromagnetic valve 160 is opened, and the first electromagnetic valve 140 is closed. On the one hand, a mixture of the refrigerant and the non-condensable gas is pumped into the low-temperature separator 230 in the purification loop 200 through the inlet 231 of the refrigerant to be purified from the flow outlet 112 of the refrigerant to be purified at the top of the condenser. On the other hand, the purification compressor 210 in the purification loop 200 starts to work, so that a working refrigerant in the purification loop 200 is compressed by the purification compressor 210 and then flows through the purification condenser 220 so as to be condensed; subsequently, the working refrigerant is throttled by the expansion valve 240, and finally enters the low-temperature separator 230 to exchange heat with the mixture of the refrigerant and the non-condensable gas. After that, the working refrigerant flows back to the purification compressor 210, to start a new round of circle. Furthermore, the refrigerant flows out from the evaporator 120 through the first end 122 of the second auxiliary flow path, is throttled by the second throttling valve 150 and then is pumped by the circulating pump 170 to the low-temperature condenser 220 to exchange heat with the working refrigerant therein; after that, the heated refrigerant flows into the evaporator 120 through the second end 121 of the second auxiliary flow path, to continue a refrigeration cycle. In this process, after heat of the mixture of the refrigerant and the non-condensable gas is absorbed by the working refrigerant of the purification loop 200 and the temperature of the mixture is lowered, a refrigerant gas having a higher liquefaction temperature is condensed to be a refrigerant liquid and accumulates at a lower portion of the low-temperature separator 230, while the non-condensable gas having a lower liquefaction temperature still maintains a gas state and accumulates at an upper portion of the low-temperature separator 230. After that, the refrigerant liquid enters the evaporator 120 through the outlet 232 of the purified refrigerant at the bottom of the low-temperature separator 230 through the return port 123 of the purified refrigerant, to continue participating into the refrigeration cycle, while the non-condensable gas passes through the non-condensable gas outlet 233 at the top of the low-temperature separator 230 and is discharged to the atmosphere through the discharge branch.

The examples described above mainly describe the refrigerating system and the purification method for the same in the present invention. Although only some implementation manners of the present invention are described, persons of ordinary skill in the art should understand that, the present invention may be implemented in many other manners without departing from the principle and scope of the present invention. Therefore, the examples and implementation manners illustrated are construed as schematic rather than restrictive, and the present invention may cover various modifications and replacements without departing from the spirit and scope defined by the appended claims.

The invention claimed is:

1. A refrigerating system, comprising:

a refrigerating loop, comprising a compressor, a condenser, a main throttling element, and an evaporator that are connected in sequence through a pipeline;

a purification loop, comprising a purification compressor, a purification condenser, a purification throttling element, and a low-temperature separator that are connected in sequence through a pipeline, the purification loop being bi-directionally connected to the refrigerating loop through the low temperature separator and configured to separate a non-condensable gas in the refrigerating loop;

wherein the purification condenser is capable of exchanging heat with a refrigerant in the refrigerating loop;

a first auxiliary flow path, of which a first end is connected with the condenser and a second end is connected with the evaporator; when the refrigerating system runs, the purification condenser exchanging heat with the refrigerant in the refrigerating loop through the first auxiliary flow path.

2. The refrigerating system according to claim 1, wherein a first throttling valve and/or a first electromagnetic valve are/is arranged on the first auxiliary flow path.

3. The refrigerating system according to claim 1, wherein the first end of the first auxiliary flow path is connected to the bottom of the condenser, and/or the second end of the first auxiliary flow path is connected to the bottom of the evaporator.

4. The refrigerating system according to claim 1, further comprising a second auxiliary flow path, of which a first end and a second end are connected with the evaporator respectively; when the refrigerating system shuts down, the purification condenser exchanging heat with the refrigerant in the refrigerating loop through the second auxiliary flow path.

5. The refrigerating system according to claim 4, wherein the first end of the second auxiliary flow path is connected to the bottom of the evaporator, and/or the second end of the second auxiliary flow path is connected to the bottom of the evaporator.

6. The refrigerating system according to claim 4, wherein a second throttling element and/or a second electromagnetic valve are/is arranged on the second auxiliary flow path.

7. The refrigerating system according to claim 6, wherein a circulating pump is further arranged on the second auxiliary flow path.

8. The refrigerating system according to claim 1, wherein the purification condenser is a plate heat exchanger or a micro-channel heat exchanger.

9. The refrigerating system according to claim 1, wherein the refrigerating loop is connected into the low-temperature separator from a highest position or a local highest position of the refrigerating system.

10. The refrigerating system according to claim 8, wherein the refrigerating loop is connected into the low-temperature separator from the top of the compressor or the top of the condenser.

11. The refrigerating system according to claim 1, wherein the low-temperature separator is connected back to the refrigerating loop from the bottom of the condenser or the bottom of the evaporator.

12. The refrigerating system according to claim 1, wherein the refrigerating loop is connected into the top of the low-temperature separator.

13. The refrigerating system according to claim 1, wherein the purification loop further comprises: a discharge branch, configured to discharge the non-condensable gas separated by the low-temperature separator.

14. The refrigerating system according to claim 13, wherein the discharge branch is connected to the top of the low-temperature separator.

15. The refrigerating system according to claim 13, wherein a regeneration filter, an air pump, a first valve and a second valve are arranged on the discharge branch.

16. The refrigerating system according to claim 1, wherein the purification loop further comprises a pressurizing component configured to assist in low temperature separation.

17. A refrigerating system, comprising:

a refrigerating loop, comprising a compressor, a condenser, a main throttling element, and an evaporator that are connected in sequence through a pipeline;

a purification loop, comprising a purification compressor, a purification condenser, a purification throttling element, and a low-temperature separator that are connected in sequence through a pipeline, the purification loop being bi-directionally connected to the refrigerating loop through the low temperature separator and configured to separate a non-condensable gas in the refrigerating loop;

a first auxiliary flow path, of which a first end is connected with the condenser and a second end is connected with the evaporator; and a second auxiliary flow path, of which a first end and a second end are connected with the evaporator respectively;

wherein the first auxiliary flow path and the second auxiliary flow path have a common flow path, and the purification condenser is capable of exchanging heat with a refrigerant in the refrigerating loop through the common flow path.

18. The refrigerating system according to claim 17, wherein a first throttling valve and/or a first electromagnetic valve are/is arranged on the first auxiliary flow path; and/or a second throttling valve and/or a second electromagnetic valve are/is arranged on the second auxiliary flow path.

19. The refrigerating system according to claim 18, wherein a circulating pump is arranged on the second auxiliary flow path.

20. The refrigerating system according to claim 17, wherein the first end of the first auxiliary flow path is connected to the bottom of the condenser, and is connected to the bottom of the evaporator through the common flow path.

21. The refrigerating system according to claim 17, wherein the first end of the second auxiliary flow path is connected to the bottom of the evaporator, and is connected to the bottom of the evaporator through the common flow path.

22. A purification method for a refrigerating system, comprising:

when the refrigerating system runs, opening a first electromagnetic valve, and closing a second electromagnetic valve, wherein a refrigerant is throttled and cooled in a process of flowing through a first auxiliary flow path, exchanges heat with a purification condenser in a purification loop, and then goes back to an evaporator; and/or when the refrigerating system shuts down, opening the second electromagnetic valve and a circulating pump, and closing the first electromagnetic valve, wherein the refrigerant is throttled and cooled in a process of flowing through a second auxiliary flow path, exchanges heat with the purification condenser in the purification loop, and then goes back to the evaporator.

23. The purification method according to claim 22, further comprising:

starting the purification loop, wherein the purification refrigerant is compressed through a purification compressor, enters the purification condenser to exchange heat, is throttled by a purification throttling element, and then enters a low-temperature separator to exchange heat with a refrigerant to be purified, separating the refrigerant into a non-condensable gas and a liquid refrigerant.

24. The purification method according to claim 23, wherein under a same pressure, the non-condensable gas has a liquefaction temperature lower than that of the refrigerant, and cannot chemically react with the refrigerant and/or the refrigerating system.

25. The purification method according to claim 24, wherein the non-condensable gas is air or nitrogen.

* * * * *